US006824331B2

(12) United States Patent
Parker

(10) Patent No.: US 6,824,331 B2
(45) Date of Patent: Nov. 30, 2004

(54) SCREW FORM ANCHOR DEVICE

(76) Inventor: Clifford Alan Parker, 10 Rimu Road Mangere Bridge, Auckland (NZ)

( * ) Notice: Subject to any disclaimer, the term of this patent is extended or adjusted under 35 U.S.C. 154(b) by 0 days.

(21) Appl. No.: 10/257,246

(22) PCT Filed: Apr. 10, 2001

(86) PCT No.: PCT/NZ01/00057

§ 371 (c)(1),
(2), (4) Date: Jan. 30, 2003

(87) PCT Pub. No.: WO01/77444

PCT Pub. Date: Oct. 18, 2001

(65) Prior Publication Data

US 2003/0147704 A1 Aug. 7, 2003

(30) Foreign Application Priority Data

Apr. 10, 2000 (NZ) ..... 503876

(51) Int. Cl.[7] ..... E21D 20/00; E21B 10/44; F16B 35/04

(52) U.S. Cl. ..... 405/259.1; 405/241; 405/252.1; 175/388; 175/391; 175/394; 52/157; 411/426

(58) Field of Search ..... 405/172, 241, 405/242, 244, 252.1, 253, 259.1; 175/323, 388, 391, 394; 52/155, 157; 248/156; 411/383, 387.4, 411, 426

(56) References Cited

U.S. PATENT DOCUMENTS 3,793,786 A * 2/1974 Jahnke ..... 52/157
4,458,765 A * 7/1984 Feklin et al. ..... 175/394
4,549,616 A * 10/1985 Rumpp et al. ..... 175/394
5,031,707 A * 7/1991 Gerasimenko et al. ..... 175/323
5,575,122 A * 11/1996 Hamilton et al. ..... 52/157
5,722,498 A * 3/1998 Van Impe et al. ..... 405/241
5,934,836 A * 8/1999 Rupiper et al. ..... 405/244
6,454,494 B1 * 9/2002 Agnew ..... 405/172
6,471,445 B2 * 10/2002 Stansfield ..... 405/232

FOREIGN PATENT DOCUMENTS

| | | | |
|---|---|---|---|
| DE | 24 40 696 | | 3/1976 |
| EP | 371533 | * | 6/1990 |
| EP | 1 061 182 A1 | | 12/2000 |
| FR | 2 378 198 | | 8/1978 |
| JP | 2000/001850 A | | 1/2000 |

* cited by examiner

*Primary Examiner*—Jong-Suk Lee
(74) *Attorney, Agent, or Firm*—Young & Thompson

(57) ABSTRACT

A screw form anchor device (10) intended for screwed penetration into a host material. The anchor device (10) includes a body (11) having a manipulating end (12) and a distal end (13). A screw thread (22) is formed by a plurality of tapering angular helix thread forms (22*a*) which extend from the distal end. Each angular helix thread form (22*a*) has an outward facing surface (24) and, relative to the distal end, a downward facing surface (25). In the preferred form an emergent helix thread (26) commences from a point distant from the distal end (13). This emergent helix thread (26) extends toward the manipulating end (12) of the body (11).

45 Claims, 7 Drawing Sheets

10
11
12
12'
13
14
15
16
17
18
18'
19
20
21
22
22a
23
24
25
26
26a
27
28
29

47
45
10
22
M

P
L
41
22
42
43
10
12
22

26
35'
35
10
22

E
44
26
22
10

38
40
39
10
19'
10

SCREW FORM ANCHOR DEVICE

BACKGROUND TO THE INVENTION

The present invention relates to improvements in anchor devices.

It is known to provide an anchor device based on a self-tapping screw design. Such an anchor device being based on a tapered helix ramp begins to lose its penetrative and anchorage properties as the material (the "host material") into which it is screwed becomes harder, less elastic and/or fibrous.

A conventional self-tapping screw has a helix coil that protrudes from the body of the screw in the form of fin-like profiles. The fins are predominantly tapered to be substantially sharp at their outer tips. The taper angle of the helix profile fin is usually substantially the same either side of the central longitudinal axis of the fin. The space between adjacent fins are generally of a V to a U shape or a transform between the two. This transformation is likely to be due to the change in the rising angle of a helix profile necessary to gain a given pitch with the changing circumference brought about by the taper. The V or U shape naturally creates a greater total surface per screw perimeter area than would a straight taper measured at the helix outer perimeter.

As suitable as a tapered helix may be for elastic and fibrous host materials, it becomes less suitable as the host material becomes harder, less elastic and/or fibrous.

There are two primary and often interlinked reasons why conventional self-tapping screw design anchors fail. On the one hand failure can occur when unsustainable demands are placed on the inward penetration forces, screw turning forces and screw strength. On the other hand, failure can result when the helix thread path is broken or stripped.

Likely cause and effects involved in failure of a self-tapping screw design anchor include:

- The top to bottom cavity spaces and surface areas between helixes become an entrapment for host material. The material must be transformed from its in situ state into a state of elasticity or fluidity which under pressure begins to adhere to the surface area. The fluidity may be due to host material elasticity or movement of broken down, granulated host materials or combinations of the two.
- Harder host materials create higher volume displacement resistance to the penetration of the anchor and upward forces act against the helix or thread path. This upward force combines with a twisting and expansive force versus directional motion force relative to the axis of the screw which deforms the host material into a fluid-like moving state. The greater surface area of the entrapping V or U shape causes the host material to adhere to the surface area. The rotary movement of the screw penetration thus demands a sheer between the screw and the host material relative to directional motion and forces.
- Forces occurring internally within the host material, screw and host material strength and helix design thus determine the limitation of a self-tapping screw for a particular host material.
- Host material without fibre, or at a force beyond adequate fibre support allows the helix encased host material to adhere to the screw and to form a shear line of least resistance that inevitably forms an upward expanding conical shape. Should the screw helix design and strength be greater than the host material under the forces applied then the host material would shear at the upward expanding cone shape defined by the outer perimeter of the helix or helixes. Should the host material be the stronger the forces may be sufficient for the helix to sheer at the body of the screw thus resulting in a stripping of the threaded path. Alternatively, random spaces between the screw body and the helix perimeter the shear line will pass through both helix and host material and strip.

A further cause of screw failure can arise from volume displacement resistance. Harder materials have the strength at volume or distance to "float" up or resist the penetration of the volume of the anchor device. The directional force of volume displacement resistance both influences the direction of shear and the effect it has on shearing the helix path such that the screwed rotation breaks away a carrot shaped cone and the helix path leading to failure. Elastic and fibrous materials create friction resistance to turning mostly by sideways forces. Experience shows that volume displacement forces in soils and soft fissil is the prime cause of stripping.

SUMMARY OF THE INVENTION

An object of the present invention is thus to provide a screw form anchor device which provides better control of the forces that govern what the screw and the host material must endure to function when host materials become stronger, harder, less flexible and less fibrous.

According in one broad aspect of the invention there is provided a screw form anchor device including a body having a manipulating end and a distal end, a screw thread formed by a plurality of tapering angular helix thread forms extending away from said distal end toward said manipulating end, each angular helix thread form having an outward facing surface and, relative to the distal end, a downward facing surface. In one form of the invention an emergent helix thread commences from a point distant from the distal end and extends toward the manipulating end. The emergent helix thread can be continuous or discontinuous.

In the preferred form of the invention the outward facing surface is directed upwardly relative to the distal end. The downward facing surface is substantially normal to a longitudinal axis of symmetry of the body. In the preferred form the distal end of the body is pointed. The emergent helix can be derived from one of said plurality of helix thread forms.

The emergent helix thread preferably has an outward and upward facing peripheral surface for at least part of its length. Preferably the emergent helix thread has an outward and downward facing peripheral surface as the emergent helix thread approaches a terminal end remote from the distal end.

According to one form of the invention one or more of said helix threads of the helix thread form can merge at a point distant from said distal end. Such merging can occur prior to or after the commencement of the emergent helix thread.

One form of the invention has the helix thread form discontinuing at a point after commencement of the emergent helix thread.

The emergent helix thread can be of a tapering or substantially constant peripheral diameter or a combination of both.

In one form of the invention the body is joined at the manipulating end by an extension body which includes a helix thread. A multiplicity of said extension bodies may be provided and joined longitudinally end to end relative to the anchor device.

DESCRIPTION OF THE PREFERRED EMBODIMENTS

Figures 1, 2:
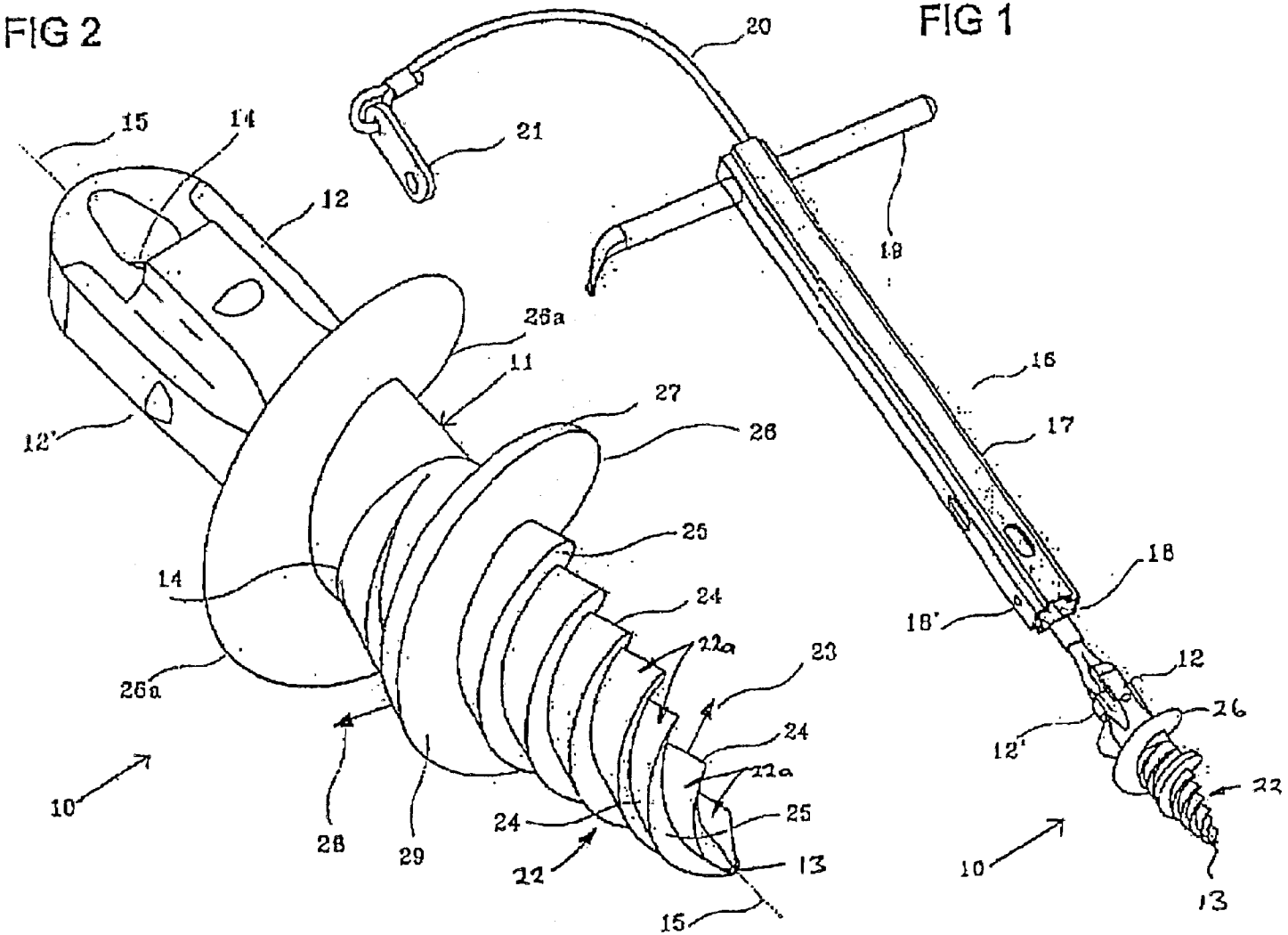
FIG. 1 is a perspective illustration of the anchor device according to one form of the invention when combined with a tool suitable for inserting the anchor device into a host material.
FIG. 2 is an enlarged perspective view of the anchor device as shown in FIG. 1.
Figure 3:
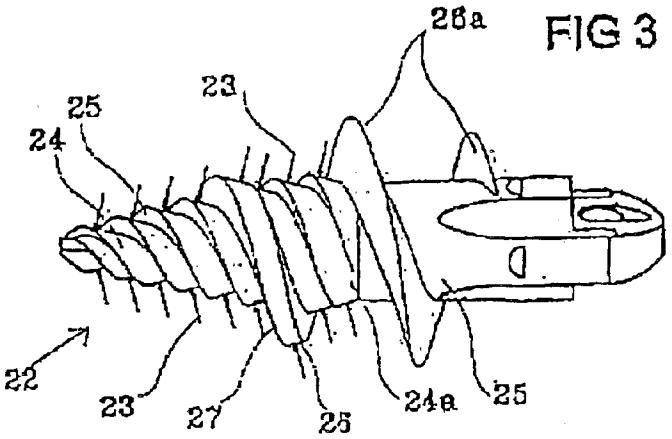
FIG. 3 is a side perspective view of a further form of the anchor device as shown in FIGS. 1 and 2.
Figure 4:
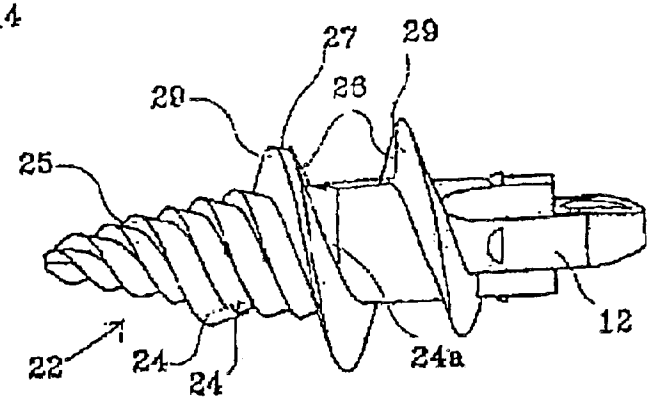
FIG. 4 is a different side perspective of the anchor device of FIG. 3.
Figure 5:
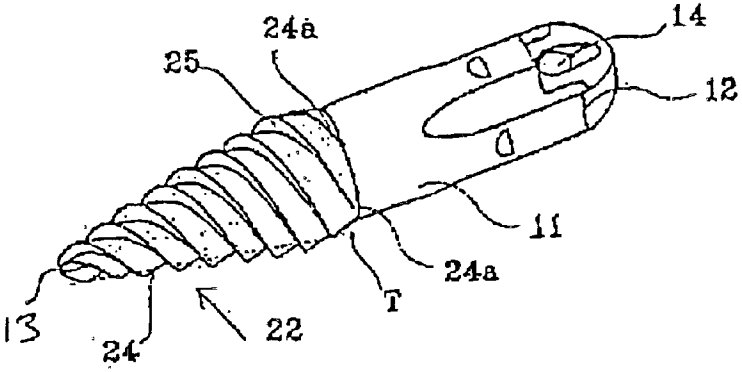
FIG. 5 is perspective view of the anchor device but showing only the L-screw as hereinafter described.

Referring firstly to FIGS. 1 and 2 there is shown an anchor device 10 comprising a body 11 having a manipulating end 12 and a distal or pointed end 13. The manipulating end 12 has a form whereby a force to enable rotation of the device 10 about its central longitudinal axis 15 can be applied.

This rotational action can, for example, be applied by a tool 16 of a type illustrated by way of example in FIG. 1. As shown, the tool 16 can comprise a body 17 with a laterally extending (preferably removable) handle 19 at one end. The other end of the body 17 can have an opening 18 into which end 12 of anchor device 10 can engage. In the preferred form, end 12 of the anchor device 10 has an angular cross-sectional shape which is at least in part replicated by the shape of opening 18. Thus, when end 12 is in opening 18 an angular movement about the longitudinal axis of body 17 is translated into a rotational movement of the anchor 10 about axis 15.

In the preferred form of the invention a flexible member 20 anchored through an opening 14 in end 12 can extend through body 17 (which preferably is hollow) to terminate in, say, a tab or plate 21.

If desired, relative longitudinal movement between the anchor device 10 and the body 16 can be prevented by a suitable fastener (not shown) inserted through opening 18' adjacent the end of body 17 into which the part 12 of the anchor device 10 engages. This fastener can engage with a surface, recess or the like 12' in part 12 to thereby prevent relative longitudinal movement between part 12 and body 17 from occurring.

In one form of the invention the anchor device can be inserted into the host material (ie the ground) by use of tool 16 and become buried within the ground up to a depth as may be desired. The depth may be limited by the available length of tool body 17 if the anchor device is to be buried deep. The tool body 17 (provided that it has not been fixed to anchor 10 by the fastener through opening 18) can then be withdrawn leaving the flexible element 20 in the ground with tab or plate 21 above ground level for attachment to whatever is required to be anchored. For example, a flexible element or the like would be coupled to plate 21 such as when the anchor device is to anchor a guy rope, tether or the like.

However, in the event that tool body 17 is fixed in place to the anchor device 10 the tool body 17 remains within the ground though handle 19 in such a situation would be removed thereby permitting the attachment to body 17 of whatever requires anchorage. Alternatively, body 17 could form part of the structure to be anchored or supported.

By threading the flexible member 20 through the hollow tool 16 and holding flexible member 20 taut whilst manipulating the tool down the member 20 as a guide it is possible to locate body 17 so that it re-engages with part 12 of the anchor device 10. This enables a turning action to be applied in reverse manner to the anchor device so that it can be screwed out of the host material.

Referring now to FIG. 2, the basic construction of the anchor device 10 is shown. An L-screw 22 is applied to the body 11 and is formed by a plurality of angular helix threads **22*a* extending from the distal end 13 for a length along the body 11. The L-screw 22 is tapered with each of the plurality of angular threads 22*a* each having an upward and outward facing (the direction being indicated by arrow 23) helix surface 24 per pitch. L-screw 22 thus has several angular helixes 22*a* per pitch which are arranged to coil up the taper with a step-like appearance when viewed normal to the longitudinal axis of symmetry 15 of body 10. The helixes 22*a* therefore take on the appearance of a cut in the surface of the body 10 and consequently have a downward surface 25 which is near right angles to the upward and outward surface 24**.

Figure 7:
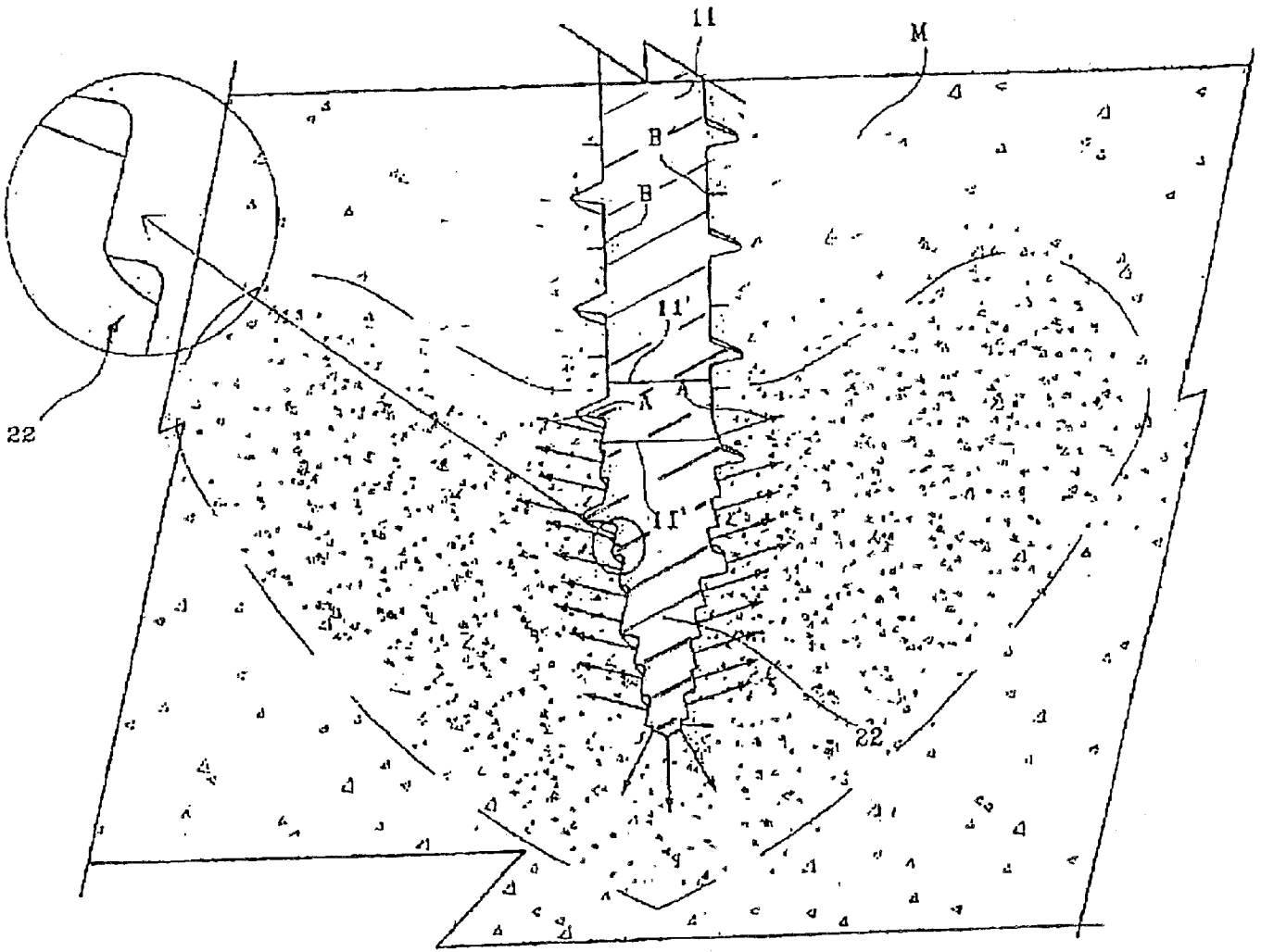
FIG. 7 is an illustration of an anchor device of a type as shown in FIG. 6 when inserted into a host material.

Preferably, and as shown in the detail in FIG. 7, all vertices of the helix threads are rounded to eliminate sub-protrusions and minimise surface area as much as practical.

As shown, each angular helix thread **22*a* begins at the pointed distal end 13** as a shallow cut groove at a fast rising angle to match the constant pitch of a larger circumference.

According to the present invention, a helix thread 26 can emerge outwardly from the L-screw 22 to form a conventional spiral helix (the "emergent helix") with an outward and upward peripheral edge surface 27 (the direction being indicated by arrow 28). Alternatively, it may transform totally into a conventional helix. Surface 29 of helix 26 substantially corresponds with the downwardly facing surface 25 of the helixes of L-screw 22.

The L-screw 22 (other than that shown in FIG. 8) is intended for medium to hard soils and accordingly as shown can have four to eight helixes per thread pitch. This is by way of example only and more than eight or less than four helix threads 22*a* can be used. It maintains all "same pitch" helixes in a "stepped cut" helix arrangement as shown. After a select amount of revolution and progress up the body a helix begins to emerge into a profile above the others thereby forming the emergent helix 26. The emergent helix 26 retains a reducing substantially flat "outward and upward" direction of the peripheral surface 27 until it reaches a maximum circumference at which it is transformed into a substantially pointed or more conventional helix edge 26*a*.

As is shown, for example, in FIG. 2 the three non-emerging helixes 22*a* of the L-screw 22 ultimately merge inwardly at 24*a* into the body 11.

Two helixes 22*a* of the L-screw 22 may merge into one helix 22*b* (FIG. 14) as the taper diameter increases thereby allowing deeper cuts without weakening the strength of the anchor device. Merging may be by way of emerging a helix surface from a cut state to a proud state, eg an emergent helix 26. Alternatively, merging can be by way of emerging outer helix to align a surface 24 with a surface 24 of a higher helix thereby resulting in the two helixes uniting to form a larger helix 32.

In yet a further form a helix surface may be merged inwardly to align with that of a lower helix.

The references to upper and lower (or the like) are in reference to the pointed end of the anchor device being "lowermost" and the manipulating end "uppermost".

Figure 6:
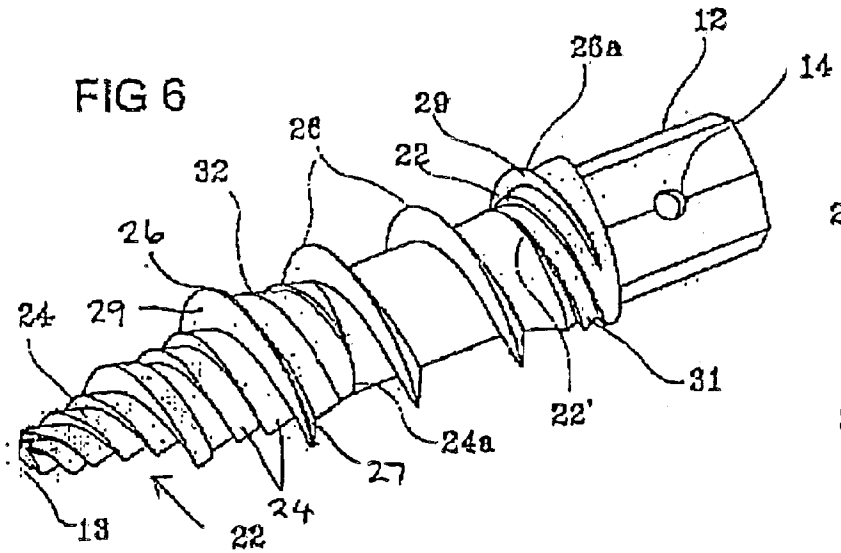
FIG. 6 is a perspective view of a fourth embodiment of the anchor device according to the present invention.

A helix of the L-screw 22 above an emergent helix 26 may merge with the lower helix to form a merge 30 (see FIG. 6) so as to eliminate an entrapment space of large surface area for host material. As also shown in FIG. 6, an emergent helix 26 (whether or not it may be in conventional form) may continue upward along the body 10 for an indefinite length. FIG. 6 furthermore shows a modified form of the end part 12 to provide a different anchorage and drive fitting.

FIG. 6, therefore, is an illustration of the scope of embodiments which can be employed in accordance with the invention as it shows an anchor having no set distribution of helixes. As can be seen, an L-screw 22 extends from the distal end 13 and incorporates an emerged helix 26 with the helix 24 continuing above the emerged helix 26 to merge into the body 11 at 24*a*. FIG. 6 also shows how some helixes can be merged out and then started again at an expanding shoulder as cuts 22' (eg as shown at 31).

FIG. 7 provides an illustration of the anchor device 10 and more particularly in profile when cut in section along the longitudinal axis 15 to show the applied forces and pressures in the host material. The densities of the material show a heart-shaped pressure zone applied to the material from the turning helix surfaces marked as arrows A and relief as indicated at B. It also shows the decreased cross-sectional area of the body at 11' and 11".

Figure 8:
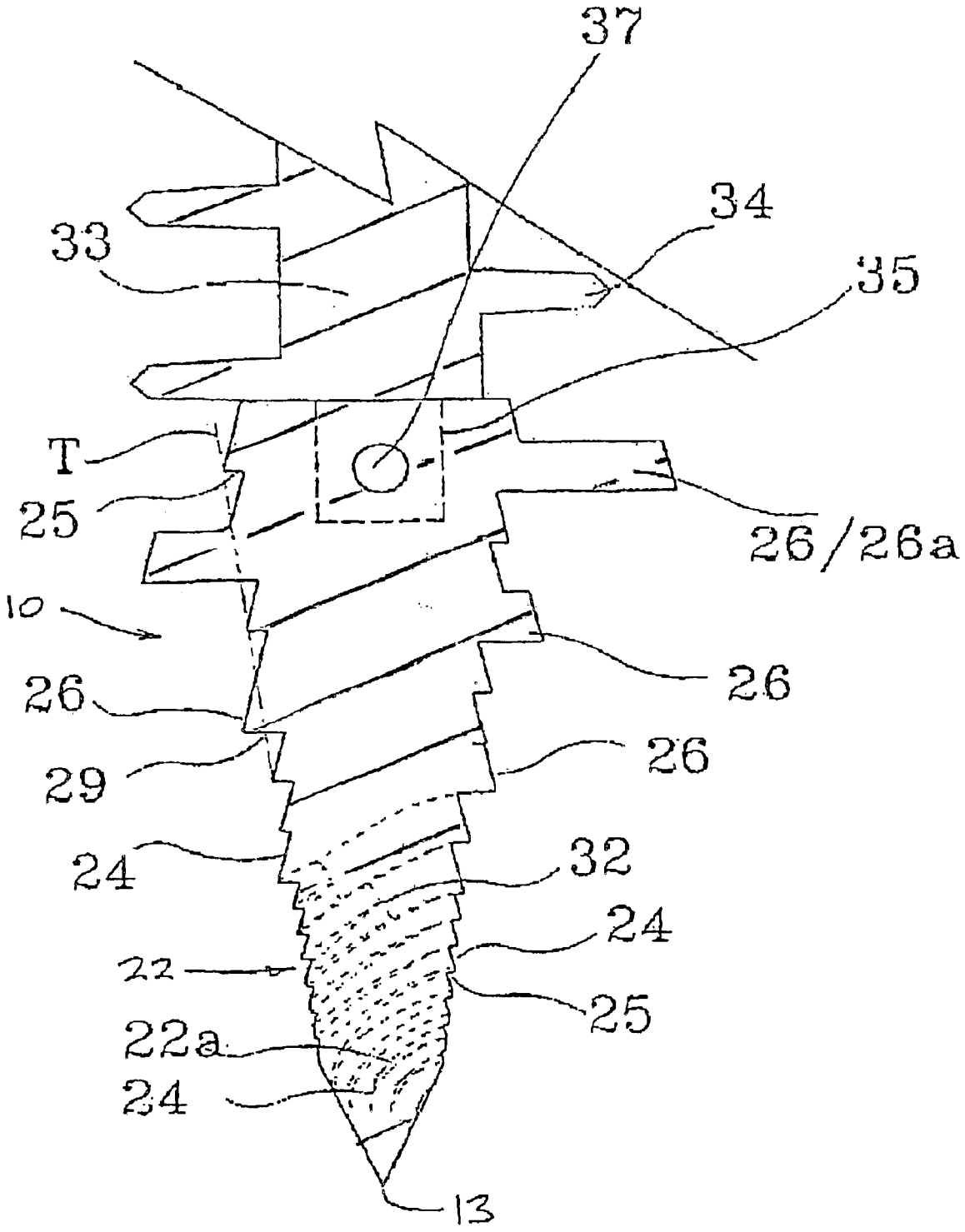
FIG. 8 is a modified form of the anchor device as shown in FIGS. 1 and 2.

FIG. 8 shows yet a further embodiment. This time the anchor device is shown in cross-sectional profile, this particular embodiment may, for example, be an earth nail for stabilising unstable earth or it may be a fixing screw to fix together various laminations of building products. Such products may have one or more layers of hard concrete-like material or materials that have lesser properties of supportable fibre and elasticity combinations.

The multiple and less deep cut helix (shown in dashed lines) provides for starting a helix close to point 13 without undue weakening of body 10 contribute to helix path and minimise penetration resistance for host materials like concrete, stones, ice or man-made hard materials.

Once again, FIG. 8 shows the cut surface forming helix 22 extending from point 13 to merge at 32 into a single helix. The taper of the body 11 is indicated by dotted line T.

Keyed into the body 10 is an extension 33 of generally circular cross-section with a conventional helix 34. As shown, body 33 can have an axially extending projection 35 which is of angular cross-section and engages in a recess in body 10 which is of commensurate shape with the projection 35. A pin 37 or the like can engage through body 10 and hence projection 35 to lock the keyed end of body 33 onto the anchor device 10.

It will be appreciated by those skilled in the art that a multiple of body 33 could be end to end keyed and joined together to provide a required length.

The total surface area of the tapered "T" conical body portion into which the L-screw 22 is formed together with the emergent helix 26 is less than that of conventional helix screw anchor devices. The present invention thus has a lesser initial self-tapping screw helix protrusion than is conventional as it is preferred to secure the helix pitch path or thread path into the host material. Accordingly, the outward and upward shear surfaces are of maximised area and minimised surrounding entrapments to host material contrary to the situation with a conventional outward biting helix. As with any self-tapping screw the anchor device of the present invention firstly depends on maintaining its threaded path penetration in order to function.

The upper emergent helix 26 adds anchorage from shearing surfaces already established as helix paths in the soil by the L-screw 22. This provides a greater anchorage/support than is otherwise available with conventional helix screw anchor devices.

Accordingly, the L-screw 22 provides the prime expanding penetration and establishes a helix path for the emergent helix. Hence the more conventional helix which follows L-screw 22 engage into the host material at a greater "depth" thereby enabling the anchorage device of the present invention to be used in host materials which previously could not conveniently be "self-tapped".

Figures 9, 10, 11, 12, 13:
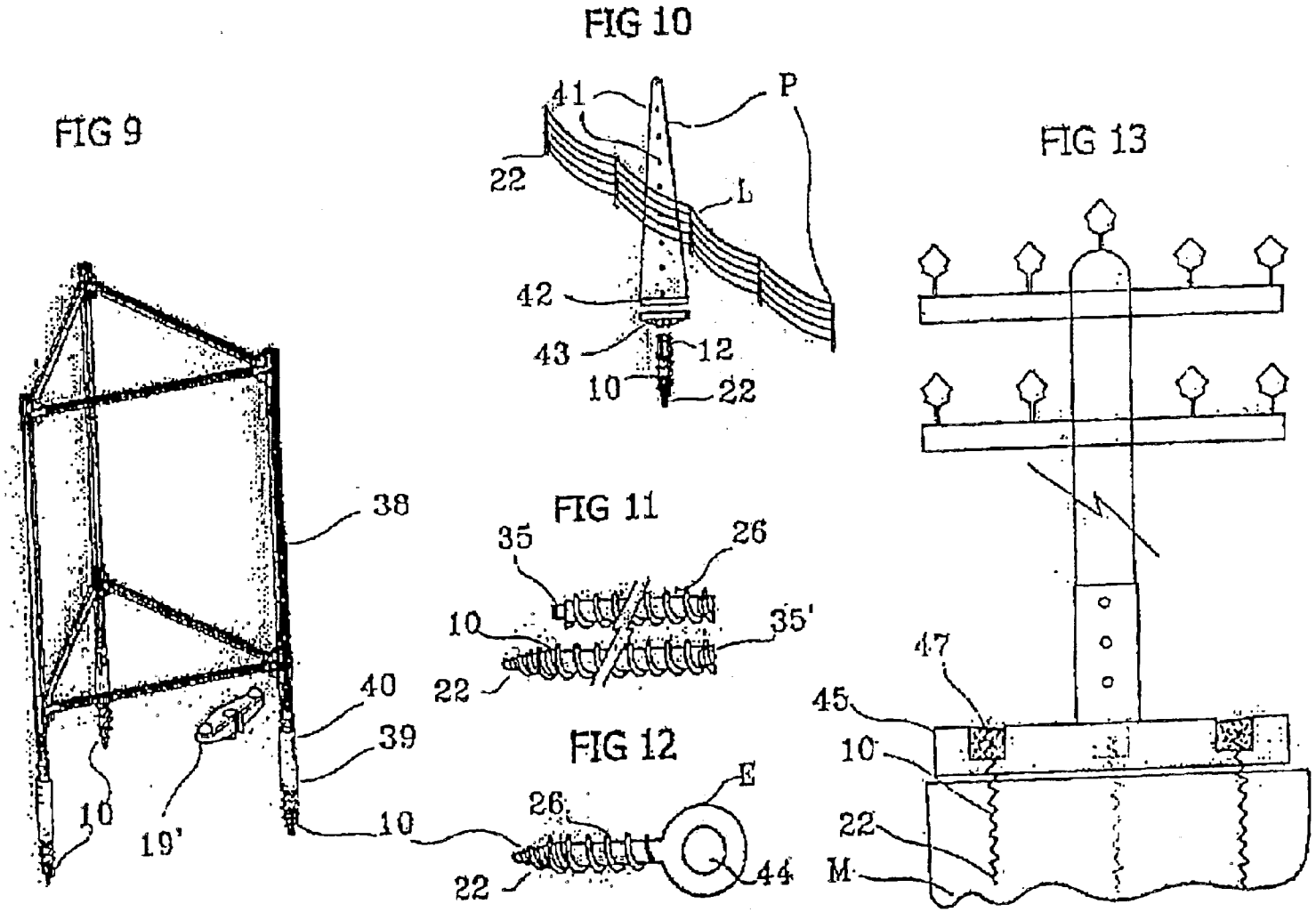
FIG. 9 depicts a framework or structures supported by anchor devices according to the present invention.
FIG. 10 shows superimposed on an illustration of a fence line a post anchorable by an anchor device of the present invention.
FIG. 11 is an illustration of an embodiment of the arrangement shown in FIG. 7.
FIG. 12 depicts an eye screw incorporating the present invention.
FIG. 13 is an illustration of a pole or tower in conjunction with a base anchored by anchor devices according to the present invention.

FIGS. 9 to 13 provide illustrations of different end uses of an anchor device of any one of the forms described herein. For example, FIG. 9 depicts a frame or tower 38 structure having lower or foot portions coupled to anchor devices 10. This attachment can be provided by extension or mounting pieces 39 coupled in a suitable manner to feet 40.

The extensions 39 can be in the form of a body 17 as shown in FIG. 1 and installed with an manipulating arm or crosspiece or similar tool 19'.

The anchor device has particular application for fence posts or poles of a fence line L. Each post P can be of a suitable form for the required end purposes and can, for example, include a multiplicity of openings 41 through which wires W can be engaged. The lower end 42 of post P can engage with a base plate 43 which is fixed to the anchor device 10 when installed in the ground.

FIG. 11 depicts an extendable screw shaft suitable for earth stabilisation, underground pipe installations or the like while FIG. 12 depicts a typical eye screw which can be used for masonry-like materials. A bar driver can be placed through the hole 44 in the eye screw E to apply a rotational movement along the longitudinal axis of the anchor device 10 to enable the eye screw to be inserted into all manner of host materials even up to icebergs to enable a ship's line to be fastened thereto.

Finally, FIG. 13 depicts a pole or tower base 45 with anchor devices extending into host material M. The manipulative end parts 12 of the anchor devices 10 can be located in cavities 46 which are then filled with a suitable filling material 47.

Figure 14:
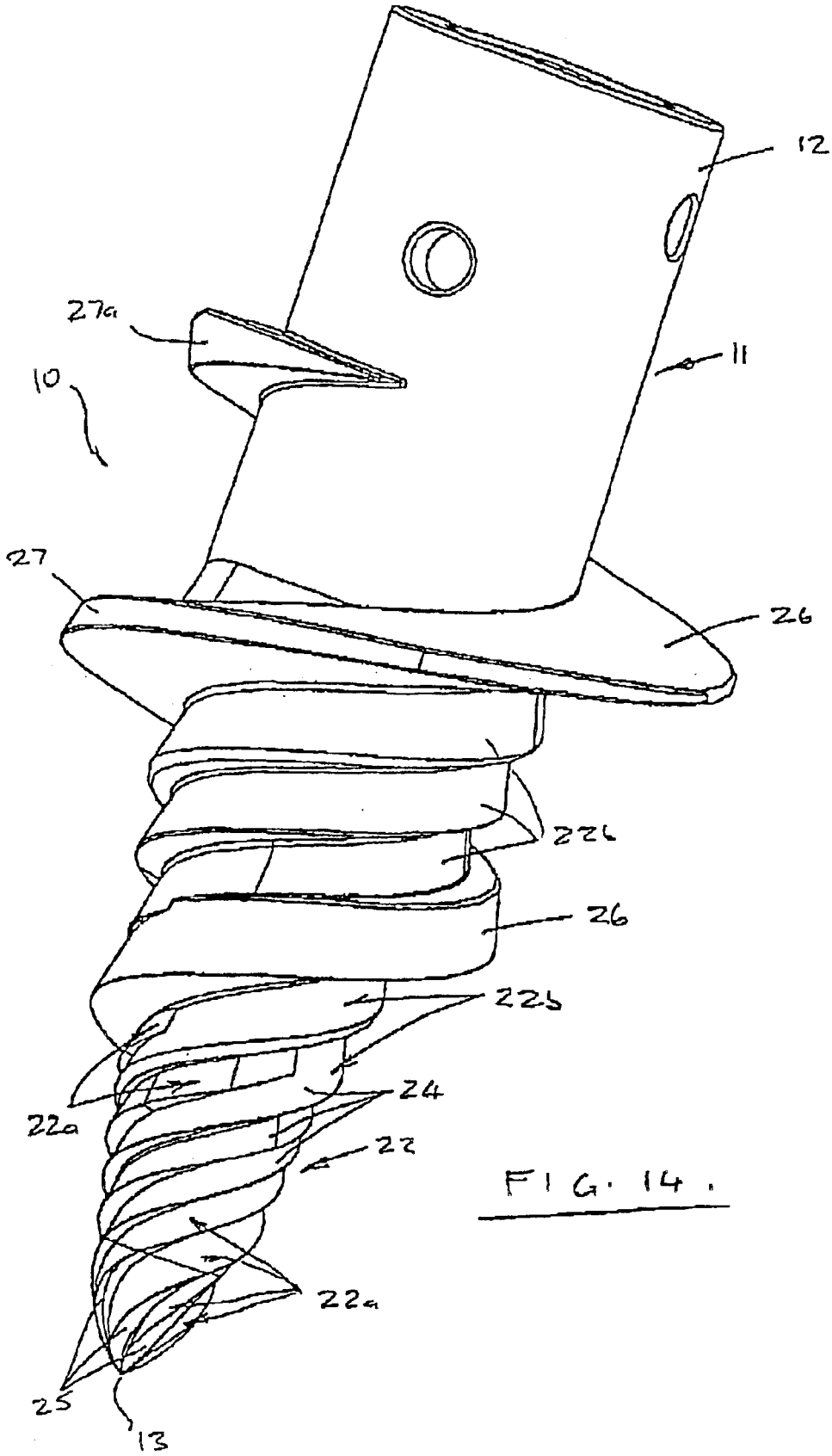
FIG. 14 is a further view, perspective in form, of an anchor device of the type shown in FIG. 8.

FIG. 14 is a further illustration of the anchor device in the form shown in FIG. 7. This illustrates the pointed distal end of 13 of the body 11 has a helix screw 22 formed by a multiplicity of angular screw thread forms 22*a* extending away from the pointed end 13. A number of the threads 22*a* merging to form continuing threads 22*b* having a wider outwardly and upwardly facing surface 24. It also illustrates the emergent thread 26 which extends beyond the terminal end of the last of the angular threads 22*a*. In this form of the invention, however, the peripheral edge of the emergent thread has a surface 27 which is outwardly and upwardly directed (as previously described) but this transforms into a peripheral edge surface 27*a* toward the upper terminal end of the emergent thread which is outwardly and downwardly projecting.

Figure 16:
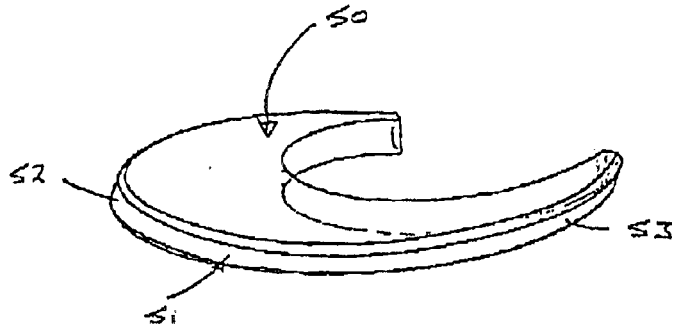
FIG. 16 is a perspective view of a short helix form mountable with the body to form a discontinuous emergent helix of the type shown in FIG. 15.
Figure 15:
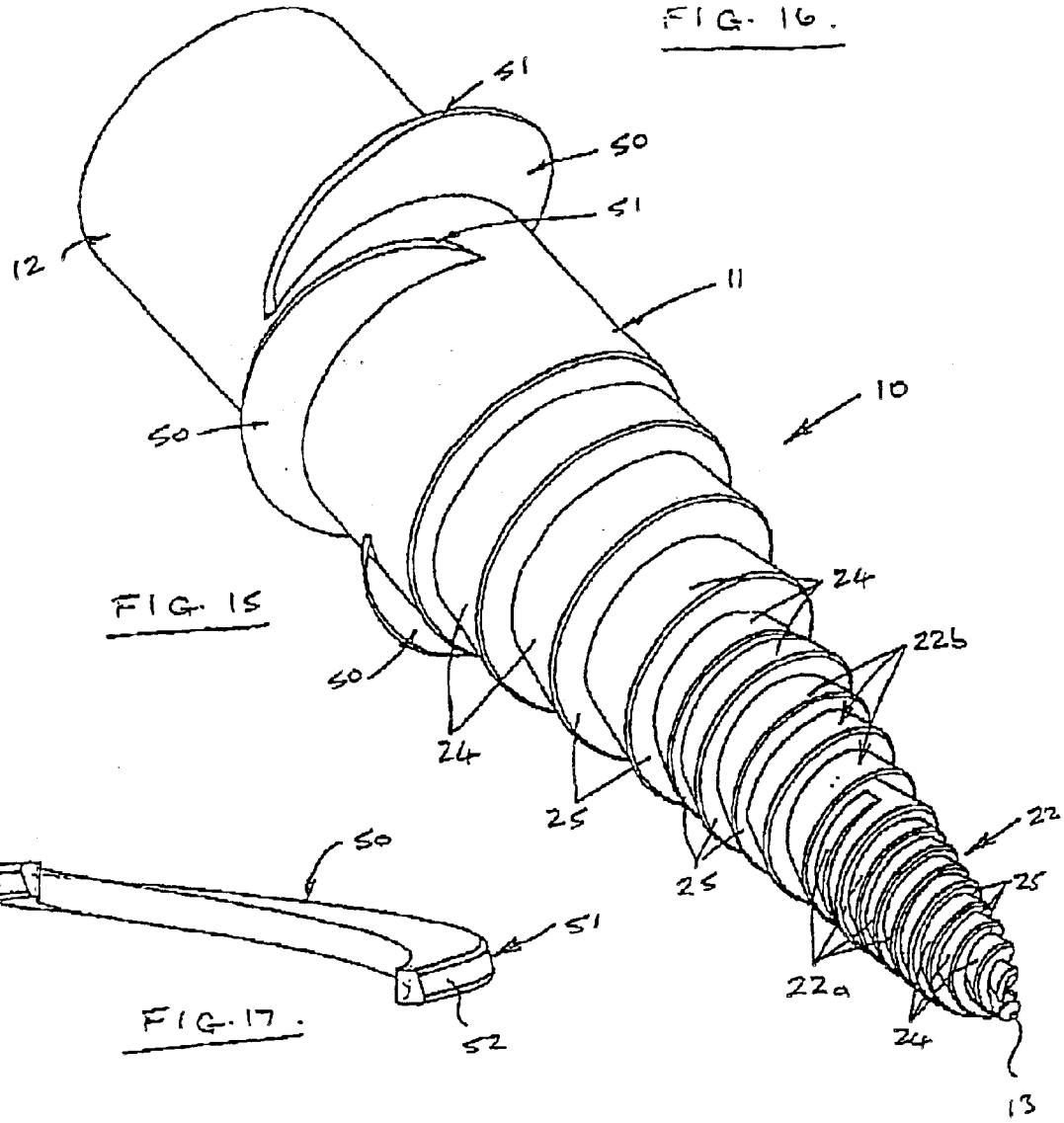
FIG. 15 is a further embodiment of the anchor device showing the use of a discontinuous emergent helix.
Figure 17:
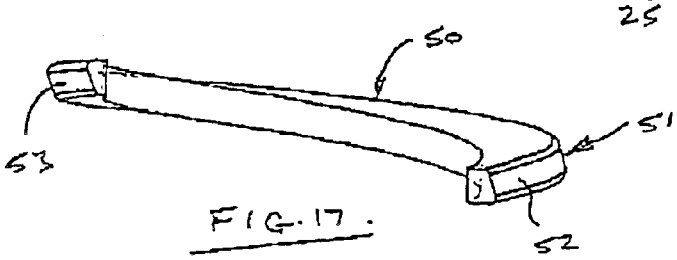
FIG. 17 is a further perspective view of the short helix of FIG. 16.

A further embodiment of the invention is shown with reference to FIGS. 15–17 where the emergent thread 26 is formed by short thread sections 50 (see FIGS. 16 and 17) which projects outwardly from the surface of the body 11 toward the manipulating end 12. These short thread sections 50 can be so located as to effectively form a helix thread but one which is discontinuous as can be seen in FIG. 15.

As with the arrangement shown in FIG. 14 the peripheral edge of these short thread sections can be outwardly and upwardly inclined or outwardly and downwardly inclined though as more preferably shown in FIG. 17 each thread section can have a peripheral edge 51 which transforms from an outwardly and upwardly directed surface 52 to outwardly and downwardly directed surface 53.

By the use of a multiplicity of angular helixes on a constant pitch extending from the pointed tip end of the anchor device the penetrating volume of the tip is minimised relative to the total volume of displacement of the host material when the anchor device is screwed into the host material. A lower resistant to initial tip penetration is thus achievable over existing anchor devices of a self tapping type.

The use of the multiplicity of angular helixes leads to a lessening of frictional edges and adhesion of materials which enables the host material to start sliding on the resultant lead-in surface of the anchor device. It has been found, for example, that with an anchor device formed of plastic with eight angular helixes extending from the tip per pitch there is a considerable increase in overall performance of the anchor device.

The sliding of host material on the angular helix surfaces while appearing to run more up and down than around like a conventional helix, nevertheless contribute to the controlled directional force under compression that retains shear strength of the non-fibrous host material that it is otherwise diminished with fluid movement of the host material. The direction of the force begins as downward and is converted to upward and outward as the taper of the body expands and the pitch forms a conventional helix with the angular helix surface continuing to smoothly reduce friction and rotational effort of the anchor device.

The merging of the angular helixes conveniently enables deeper cuts where the strength of the tip is supported by the expanding cone diameter somewhat proportionately to strain on the material of the anchor device. This creates an ever widening smooth slipping surface to continue the slippage and an increasing, proportionately with body taper diameter, an area (or bulk block) of this material under pressure that retains higher than usual shear resistance. The bulk block progresses in an upward and outward direction in the material to combat the downward resistant of the tip penetration.

This configuration may be continued until a selected size of taper expansion is considered adequate for the desired end use or host material type to create a self-supporting thread path. This results in the lowest possible turning force of the anchor device. The anchorage effect achieved by use of the anchor device may be increased (whether it be to resist pulling out of the anchor or pushing the anchor device further into the host material) by an emergent conventional helix or helixes.

The emergent helix may merge back into the shaft at any interval or spacing. Where the expanded volume of the cut helix taper is considered insufficient to relieve the pressure on the straight shafted area of the body or an entrapment area may form the helix can merge back into the body before an entrapment is formed. Any adherence of host material to the helixes may cause breakage of the host material at the outer perimeter of the helix and create a thread stripping.

The helixes may be restarted at the given pitch at later and higher levels with spacing of both distance and height so as to reduce the tearing out of host material by entrapments and/or surface adhesion. By the use of short helix elements spaced radially apart one short helix element can be located to not be aligned at the same radial direction with a height spacing between radially aligned entrapments.

The short helix elements may appear similar to a propeller blade and can have a rising circumference angle out from the body of the anchor device to ease turning effort in the host material. The rising angle has preferably an outer angle flattening surface directing contacting material it may encounter by screwing, upward and downward on the downward direction side, and a flatter surface angle direction of downward and outward on the upper slope of the returning and reducing diameter side towards the body of the anchor device.

When requiring the anchor device to be reusable and thereby achieve favourable characteristics of screwing out of the host material the rising taper volume and any helix should not rise above that of the body of the anchor device and helix (if any). The reusable anchor device may have a rising volume at the top of the taper greater than the body and have the cut helixes blend from upward and outward facing to downward and outward facing such that removal after compaction or consolidation is managed by the same surface forces as used to insert the anchor device.

What is claimed is:

1. A screw form anchor device, comprising:

a body having a manipulating end and a distal end;

a screw thread formed by a plurality of tapering angular helix thread forms extending away from said distal end toward said manipulating end, each of said helix thread forms having an outward facing surface and, relative to said distal end, a downward facing surface; and an emergent helix thread derived from one of said plurality of helix thread forms, said emergent helix thread commencing from a point distant from said distal end and extending toward said manipulating end, said emergent helix thread tapering outwardly to a distal peripheral edge.

2. The anchor device as claimed in claim 1, wherein the outward facing surface is directed upwardly, relative to said distal end.

3. The anchor device as claimed in claim 2, wherein the downward facing surface is substantially normal to a longitudinal axis of symmetry of the body.

4. The anchor device as claimed in claim 3, wherein the distal end is pointed.

5. The anchor device as claimed in claim 3, wherein all vertices associated with each of the angular helix, thread forms and the emergent helix thread are rounded.

6. The anchor device as claimed in claim 1, wherein a number of the angular helix forms ceases to exist as the cross-sectional diameter of the body increases.

7. The anchor device as claimed in claim 6, wherein a number of the angular helix thread forms decreases toward the manipulating end by merging of two or more of the angular helix thread forms into a single angular helix thread.

8. The anchor device as claimed in claim 7, wherein said merging can occur prior to or after the commencement of the emergent helix thread.

9. The anchor device as claimed in claim 1, wherein the emergent helix thread has an outward and upward facing peripheral edge for at least a part of its length.

10. The anchor device as claimed in claim 9, wherein the emergent helix thread has an outward and downward facing peripheral edge as the emergent helix thread approaches a terminal end remote from said distal end.

11. The anchor device as claimed in claim 1, wherein the emergent helix thread is continuous.

12. The anchor device as claimed in claim 1, where the emergent helix thread is discontinuous.

13. The anchor device as claimed in claim 1, wherein the emergent helix thread is of tapering or substantially constant peripheral diameter or a combination of both.

14. The anchor device as claimed in claim 1, wherein the body is joined at the manipulating end by an extension body which includes a helix thread.

15. The anchor device as claimed in claim 14, wherein a multiplicity of extension bodies are joined longitudinally end to end relative to the anchor device.

16. The anchor device as claimed in claim 1, wherein the manipulating end is configured to be engageable by a tool whereby a rotational force can be applied to the body.

17. The anchor device as claimed in claim 1, therein the emergent helix thread is formed by a plurality of separate thread sections.

18. The anchor device as claimed in claim 17, wherein each of the thread sections has a peripheral edge which transforms over the length thereof from an outwardly and upwardly directed surface to an outwardly and downwardly directed surface.

19. A screw form anchor device, comprising:

a body having a manipulating end and a distal end;

a screw thread formed by a plurality of tapering angular helix thread forms extending away from said distal end toward said manipulating end, each of said helix thread forms having an outward facing surface and, relative to the distal end, a downward facing surface; and an emergent helix thread derived from one of said plurality of helix thread forms, said emergent helix thread commencing from a point distant from said distal end and extending toward said manipulating end beyond a terminal end of said angular helix thread forms.

20. The anchor device as claimed in claim 19, wherein the downward facing surface is substantially normal to a longitudinal axis of symmetry of the body.

21. The anchor device as claimed in claim 19, wherein a number of said angular helix thread forms ceases to exist as a cross-sectional diameter of said body increases.

22. The anchor device as claimed in claim 19, wherein said emergent helix thread has an outward and upward facing peripheral edge for at least a part of its length.

23. The anchor device as claimed in claim 22, wherein said emergent helix thread has an outward and downward facing peripheral edge as said emergent helix thread approaches a terminal end remote from said distal end.

24. The anchor device as claimed in claim 19, wherein said emergent helix thread is continuous.

25. The anchor device as claimed in claim 19, wherein said emergent helix thread is discontinuous.

26. The anchor device as claimed in claim 19, wherein all vertices associated with each of said angular helix thread forms and said emergent thread are rounded.

27. The anchor device as claimed in claim 19, wherein a number of said angular helix thread forms decreases toward said manipulating end by merging of two or more of said angular helix thread forms into a single angular helix thread.

28. The anchor device as claimed in claim 27, wherein said merging occurs prior to or after the commencement of said emergent helix thread.

29. The anchor device as claimed in claim 19, wherein said emergent helix thread is of a tapering or a substantially constant peripheral diameter or a combination of both.

30. The anchor device as claimed in claim 19, wherein said body is joined at said manipulating end by an extension body which includes a helix thread.

31. The anchor device as claimed in claim 19, wherein said emergent thread is formed by a plurality of separate thread sections.

32. The anchor device as claimed in claim 31, wherein each of said thread sections has a peripheral edge which transforms over a length thereof from an outwardly and upwardly directed surface to an outwardly and downwardly directed surface.

33. A screw form anchor device comprising:

a body having a manipulating end and a pointed tip end;

a screw thread formed by a plurality of tapering angular helix thread forms extending from said pointed tip end toward said manipulating end, each of said angular helix thread forms having, relative to said pointed tip end, an outward facing surface and a downward facing surface, said outward facing surface being tapered upwardly, relative to said pointed tip end; and an emergent helix thread that commences from a point distant from said pointed tip end and extends toward said manipulating end.

34. The anchor device as claimed in claim 33, wherein said emergent helix thread is derived from one of said plurality of angular helix thread forms.

35. The anchor device as claimed in claim 33, wherein said emergent helix thread tapers outwardly to a distal peripheral edge.

36. The anchor device as claimed in claim 33, wherein said emergent helix thread has an outward and upward facing peripheral edge for at least a part of its length.

37. The anchor device as claimed in claim 33, wherein said emergent helix thread has an outward and downward facing peripheral edge as said emergent helix thread approaches a terminal end remote from said pointed tip end.

38. The anchor device as claimed in claim 33, wherein said emergent helix thread is continuous.

39. The anchor device as claimed in claim 33, wherein said emergent helix thread is discontinuous.

40. The anchor device as claimed in claim 33, wherein all vertices associated with each of said angular helix thread forms and said emergent thread are rounded.

41. The anchor device as claimed in claim 33, wherein a number of said angular helix thread forms decreases toward said manipulating end by merging of two or more of said angular helix thread forms into a single angular helix thread.

42. The anchor device as claimed in claim 41, wherein said merging occurs prior to or after commencement of said emergent helix thread.

43. The anchor device as claimed in claim 33, wherein said emergent helix thread is of a tapering or a substantially constant peripheral diameter or a combination of both.

44. The anchor device as claimed in claim 33, wherein said emergent thread is formed by a plurality of separate thread sections.

45. The anchor device as claimed in claim 44, wherein each of said thread sections has a peripheral edge which transforms over a length thereof from an outwardly and upwardly directed surface to an outwardly and downwardly directed surface.

* * * * *